US006851964B2

(12) United States Patent
Miller

(10) Patent No.: US 6,851,964 B2
(45) Date of Patent: Feb. 8, 2005

(54) RETAINER CLIP FOR RIBBON CABLE CONNECTORS

(75) Inventor: William H. Miller, Raleigh, NC (US)

(73) Assignee: Digital Recorders, Inc., Dallas, TX (US)

( * ) Notice: Subject to any disclaimer, the term of this patent is extended or adjusted under 35 U.S.C. 154(b) by 0 days.

(21) Appl. No.: 10/822,974

(22) Filed: Apr. 13, 2004

(65) Prior Publication Data

US 2004/0248455 A1 Dec. 9, 2004

Related U.S. Application Data

(63) Continuation of application No. 10/453,320, filed on Jun. 3, 2003, now abandoned.

(51) Int. Cl.[7] ..... H01R 13/62
(52) U.S. Cl. ..... 439/372
(58) Field of Search ..... 439/370, 299, 439/345, 350, 351, 357, 358, 372, 67, 77, 493

(56) References Cited

U.S. PATENT DOCUMENTS 4,165,142 A * 8/1979 Grabau ..... 439/370
4,643,503 A * 2/1987 Johnson et al. ..... 439/350
5,494,451 A * 2/1996 Bowers ..... 439/358
5,924,886 A * 7/1999 Achammer et al. ..... 439/372

* cited by examiner

*Primary Examiner*—Renee Luebke
(74) *Attorney, Agent, or Firm*—Michael A. O'Neil

(57) ABSTRACT

A retainer clip for ribbon cable connectors comprises spaced, parallel feet which are received in transversely extending apertures extending through the female component of a ribbon cable connector. Legs extend upwardly and inwardly from the feet, and male component engaging arms extend from the upper ends of the legs for resiliently securing the male component in engagement with the female component of the connector. Camming members extend from the ends of the male component engaging arms and a handle extends from the ends of the cramming members for connecting the two sides of the retainer clip.

26 Claims, 1 Drawing Sheet

RETAINER CLIP FOR RIBBON CABLE CONNECTORS

CROSS-REFERENCE TO RELATED APPLICATIONS

This application is a continuation of application Ser. No. 10/453,320 filed Jun. 3, 2003, and now abandoned.

TECHNICAL FIELD

This invention relates generally to prevention of the inadvertent disengagement of the component parts of electrical connectors, and more particularly to a retainer clip specifically adapted to retain the component parts of ribbon cable connectors in secure engagement with one another.

BACKGROUND AND SUMMARY OF THE INVENTION

Ribbon cables are frequently utilized to direct electrical signals to and from printed circuit boards, and other electrical and electronic devices. In a typical application a ribbon cable extends to a two-part connector which functions to electrically connect the conductors comprising the ribbon cable to electrical components comprising a printed circuit board or other device. The two-part connector includes a male component which receives the ribbon cable and a female component which is secured to the print circuit board or other device. The female component may be provided with latches which are intended to engage the male component for the purpose of retaining the component parts of the connector in engagement with one another.

In static applications actuation of the latches may be sufficient to retain the male component of a two-part connector and engagement with the female component thereof. However, in vehicular applications and other applications in which substantial and/or sustained vibration is encountered the latches have been found to be inadequate to the task of securing the male component of a two-part connector in engagement with the female component thereof. Thus, a need exists for a retaining device which secures the component parts of a two-part connector in engagement with one another irrespective of substantial or sustained vibration or other adverse circumstances.

The present invention comprises a retainer clip for ribbon cable connectors which overcomes the foregoing and other difficulties which have long since characterized the prior art. In accordance with the broader aspects of the invention a retainer clip for ribbon connectors includes spaced, parallel feet which are received through spaced apart apertures formed in the female component of a two-part ribbon cable connector. The feet extend to legs which extend upwardly and inwardly from the feet. Retaining arms extend from the upper ends of the legs above and parallel to the feet. The retaining arms extend to camming members which in turn extend to a handle that joins the two sides of the retainer clip.

In the practice of the invention a ribbon cable is secured in the male component of a two-part ribbon cable connector. The male component is engaged with the female component of the two part connector and is initially secured by latches mounted on the female component for retaining engagement with the male component. After the male component of the two-part connector is in place, the feet of the retainer clip of the present invention are extended through spaced, parallel apertures extending transversely through the female component of the connector. As the feet move into the apertures of the female component, the camming members of the retainer clip engage the upper surface of the male component causing the retaining arms of the retainer clip to flex upwardly. As the feet continue to move through the apertures in the female component, the camming members of a retainer clip move entirely across the upper surface of the male component of the connector thereby allowing the retaining arms of the retainer clip to flex downwardly into engagement with the upper surface of the male component. In this manner the retainer clip of the present invention secures the male component of the two-part connector in engagement with the female component thereof regardless of vibration or other adverse circumstances.

Alternatively, the handle of the retainer clip may be used to flex the retaining arms upwardly as the feet are moved through the apertures of the female component of the two-part connector. When the feet are fully seated in the apertures of the female component, the handle is released allowing the retaining arms to securely engage and retain the male component of the two-part connector.

BRIEF DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
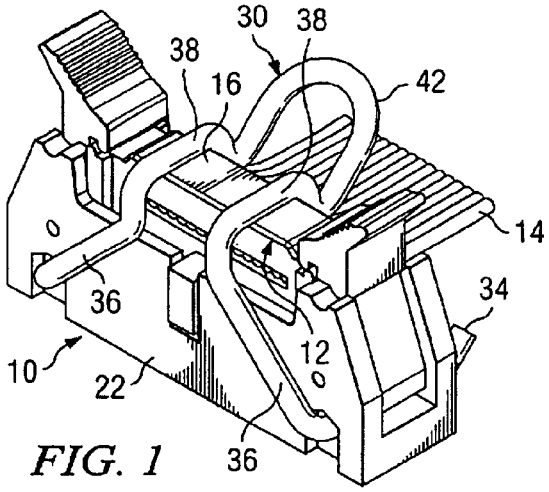
FIG. 1 is a front perspective view of a two-part ribbon cable connector having the retainer clip of the present invention installed thereon.
Figure 2:
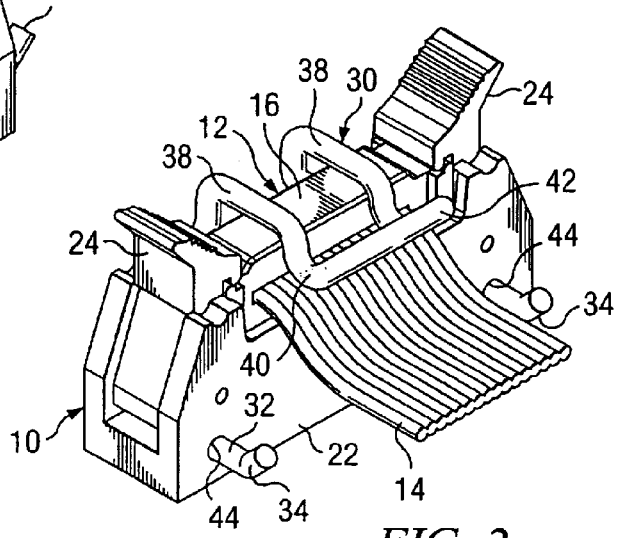
FIG. 2 is a rear perspective view of the two-part ribbon cable connector of FIG. 1 further illustrating the retainer clip of the present invention.
Figure 3:
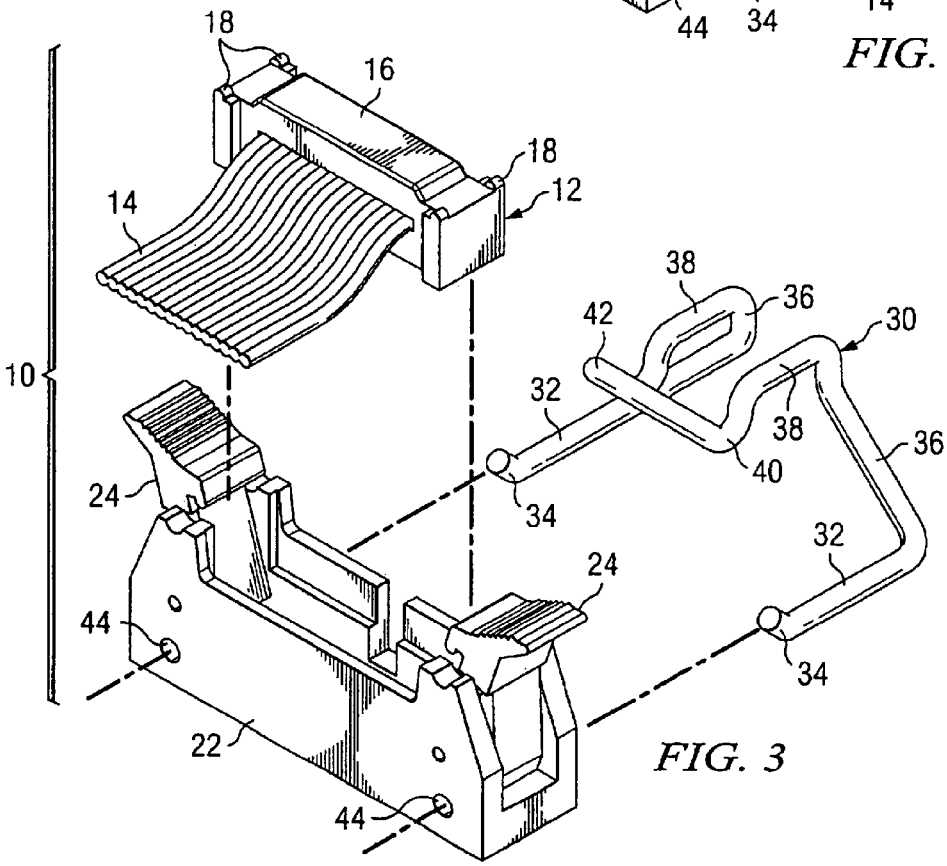
FIG. 3 is an exploded perspective view illustrating the two-part ribbon cable connector of FIG. 1 and the retainer clip of the present invention.

Referring now to the Drawings, and particularly to FIG. 3 thereof, there is shown a two-part ribbon cable connector 10. The connector 10 includes a male component 12 which receives a ribbon cable 14. The male component 12 of the two-part connector 10 comprises internal components which establish electrical connections with each of the conductors comprising the ribbon cable 14. The male component 12 has an upper surface 16 and latch engaging members 18 positioned at the opposite ends of the upper surface 16.

The two-part connector 10 further includes a female component 22. In the use of the two-part connector 10 the female component 22 is secured to an underlying printed circuit board or other electrical or electronic device (not shown). The female component 22 includes internal components which engage internal components of the male component 12 to form electrical connections therewith. In this manner the two-part connector 10 functions to establish electrical connections between each of the conductors comprising the ribbon cable 14 and the underlying device having the female component 22 of the two-part connector 10 secured thereto.

The female component 22 is provided with latches 24 located at the opposite ends thereof. As the male component 12 is engaged with the female component 22 of the two-part connector 10 the latches 24 are pivoted or cammed outwardly. When the male component 12 is fully seated within the female component 22, the latches 24 engage the latch engaging members 18 of the male component 12 to secure the male component into engagement with the female component 22. The latches 24 are adequate to retain the male component 12 in engagement with the female component 22 in static applications of the two-part connector 10, but have been found to be inadequate in circumstances in which the two-part connector 10 is subjected to substantial and/or continuing vibration. Such applications include vehicular applications and similar applications.

FIG. 3 further illustrates a retainer clip for ribbon cable connectors 30 comprising the present invention. The retainer clip 30 comprises a unitary structure which may be formed from various metals including steel, stainless steel, aluminum, etc. The retainer clip 30 may also be formed from various plastic materials including polyethylene, polypropylene, polystyrene, etc.

The retainer clip 30 comprises spaced parallel feet 32 which may be provided with retainer toes 34 at the distal ends thereof. Legs 36 extend angularly inwardly and upwardly from the feet 32. Retaining arms 38 extend from the upper ends of the legs 36 parallel to and above the feet 32. Camming members 40 extend from the ends of the retaining arms 38. The camming members 40 are connected by an angularly upwardly extending handle 42 which joins the two sides of the retainer clip 30.

In the practice of the invention a ribbon cable is secured in the male component of a two-part ribbon cable connector. The male component is engaged with the female component of the two part connector and is initially secured by latches mounted on the female component for retaining engagement with the male component. After the male component of the two-part connector is in place, the feet of the retainer clip of the present invention are extended through spaced, parallel apertures 44 extending transversely through the female component of the connector. As the feet move into the apertures 44 of the female component, the camming members of the retainer clip engage the upper surface of the male component causing the retaining arms to flex upwardly. As the feet continue to move through the apertures 44 in the female component, the camming members of a retainer clip move entirely across the upper surface of the male component of the connector thereby allowing the retaining arms of the retainer clip to flex downwardly into engagement with the upper surface of the male component. In this manner the retainer clip of the present invention secures the male component of the two-part connector in engagement with the female component thereof regardless of vibration or other adverse circumstances.

Alternatively, the handle of the retainer clip may be used to flex the retaining arms upwardly as the feet are moved through the apertures 44 of the female component of the two-part connector. When the feet are fully seated in the apertures 44 of the female component, the handle is released allowing the retaining arms to securely engage and retain the male component of the two-part connector.

Although preferred embodiments of the invention have been illustrated in the accompanying drawings and described in the foregoing detailed description, it will be understood that the invention is not limited to the embodiments disclosed, but is capable of numerous rearrangements, modifications, and substitutions of parts and elements without departing from the spirit of the invention.

What is claimed is:

1. For use in conjunction with a two-part electrical connector comprising a male component and a female component for receiving the male component and having spaced, parallel transversely extending apertures extending from a first side to a second side therethrough, a retainer clip for securing the male component in engagement with the female component of the connector comprising:

spaced parallel feet spaced a predetermined distance apart equal to the distance separating the transversely extending apertures through the female component of the connector and having a length extending from the first side to the second side;

legs extending upwardly and inwardly from the feet adjacent the first side;

male connector engaging arms extending from the ends of the legs remote from the feet parallel to and above the feet and having a length extending transversely across the male connector;

camming members extending downwardly from the ends of the male connector engaging arms remote from the legs and positionable adjacent to the second side;

means connecting the two sides of the retainer clip; and the feet, legs, engaging arms, camming members, and connecting means defining a continuous wire spring retainer clip having a spring action which normally biases the retainer clip to hold the male component and the female component of the two part electrical connector suitably engaged with a continuously applied force such that the engagement resists shock and vibrational forces which might otherwise dislodge the engagement therebetween.

2. The retainer clip according to claim 1 wherein the feet are selectively positionable with respect to one another to facilitate engagement of the feet with the apertures extending through the female component of the connector.

3. The retainer clip according to claim 1 wherein the camming members flex the retainer clip into an open configuration upon engagement with the male component of the two part electrical connector to enable the retainer clip to be extended over the two part electrical connector and thereafter release the retainer clip to resiliently clamp the male and female components of the two part electrical connector in engagement with one another.

4. The retainer clip according to claim 1 wherein the feet comprise toes which are extendable upwardly adjacent to the second side.

5. The retainer clip according to claim 1 wherein the connecting means comprises a handle which facilitates flexure of the engaging arm away from the feet thereby facilitating removal of the retainer clip.

6. The retainer clip according to claim 5 wherein the handle is adapted to open the retainer clip responsive to the application of a force thereto.

7. For use in conjunction with a two-part electrical connector comprising a male component and a female component for receiving the male component and having spaced, parallel transversely extending apertures extending from a first side to a second side therethrough, a single retainer clip for securing the male component in engagement with the female component of the connector comprising:

spaced parallel feet spaced a predetermined distance apart equal to the distance separating the transversely extending apertures through the female component of the connector and having a length extending from the first side to the second side;

legs extending upwardly and inwardly from the feet adjacent the first side;

male connector engaging arms extending from the ends of the legs remote from the feet parallel to and above the feet and having a length extending transversely across the male connector;

camming members extending downwardly from the ends of the male connector engaging arms remote from the legs and positionable adjacent to the second side;

means connecting the two sides of the retainer clip; and wherein the feet, the legs, the engaging arms, the camming members, and the connecting means defining a single, continuous wire spring retainer clip having a spring action which normally biases the retainer clip to hold the male component and the female component of the two part electrical connector suitably engaged with a continuously applied force such that the engagement resists shock and vibrational forces which might otherwise dislodge the engagement therebetween.

8. The retainer clip according to claim 7 wherein the feet are selectively positionable with respect to one another to facilitate engagement of the feet with the apertures extending through the female component of the connector.

9. The retainer clip according to claim 7 wherein the camming members flex the retainer clip into an open configuration upon engagement with the male component of the two part electrical connector to enable the retainer clip to be extended over the two part electrical connector and thereafter release the retainer clip to resiliently clamp the male and female components of the two part electrical connector in engagement with one another.

10. The retainer clip according to claim 7 wherein the feet comprise toes which are extendable upwardly adjacent to the second side.

11. The retainer clip according to claim 7 wherein the connecting means comprises a handle which facilitates flexure of the engaging arm away from the feet thereby facilitating removal of the retainer clip.

12. The retainer clip according to claim 11 wherein the handle is adapted to open the retainer clip responsive to the application of a force thereto.

13. An electrical connector comprising:

a male component;

a female component for receiving the male component and having spaced, parallel transversely extending apertures extending from a first side to a second side therethrough;

a retainer clip for securing the male component in engagement with the female component of the connector comprising;

spaced parallel feet spaced a predetermined distance apart equal to the distance separating the transversely extending apertures through the female component of the connector and having a length extending from the first side to the second side;

legs extending upwardly and inwardly from the feet adjacent the first side;

male connector engaging arms extending from the ends of the legs remote from the feet parallel to and above the feet and having a length extending transversely across the male connector;

camming members extending downwardly from the ends of the male connector engaging arms remote from the legs and positionable adjacent to the second side;

means connecting the two sides of the retainer clip; and wherein the feet, the legs, the engaging arms, the camming members, and the connecting means define a single, continuous wire spring retainer clip having a spring action which normally biases the retainer clip to hold the male component and the female component of the two part electrical connector suitably engaged with a continuously applied force such that the engagement resists shock and vibrational forces which might otherwise dislodge the engagement therebetween.

14. The electrical connector according to claim 13 wherein the feet are selectively positionable with respect to one another to facilitate engagement of the feet with the apertures extending through the female component of the connector.

15. The electrical connector according to claim 13 wherein the camming members flex the retainer clip into an open configuration upon engagement with the male component of the two part electrical connector to enable the retainer clip to be extended over the two part electrical connector and thereafter release the retainer clip to resiliently clamp the male and female components of the two part electrical connector in engagement with one another.

16. The electrical connector according to claim 13 wherein the feet comprise toes which are extendable upwardly adjacent to the second side.

17. The electrical connector according to claim 13 further comprising a printed circuit board, and wherein the female component is attached to the printed circuit board and the male component comprises a ribbon cable.

18. The electrical connector according to claim 13 wherein the connecting means comprises a handle which facilitates flexure of the engaging arm away from the feet thereby facilitating removal of the retainer clip.

19. The electrical connector according to claim 18 wherein the handle is adapted to open the retainer clip responsive to the application of a force thereto.

20. An electrical connector comprising:

a male component;

a female component for receiving the male component and having spaced, parallel transversely extending apertures extending from a first side to a second side therethrough;

a single retainer clip for securing the male component in engagement with the female component of the connector comprising;

spaced parallel feet spaced a predetermined distance apart equal to the distance separating the transversely extending apertures through the female component of the connector and having a length extending from the first side to the second side;

legs extending upwardly and inwardly from the feet adjacent the first side;

male connector engaging arms extending from the ends of the legs remote from the feet parallel to and above the feet and having a length extending transversely across the male connector;

camming members extending downwardly from the ends of the male connector engaging arms remote from the legs and positionable adjacent to the second side;

means connecting the two sides of the retainer clip; and wherein the feet, the legs, the engaging arms, the camming members, and the connecting means define a single, continuous wire spring retainer clip having a spring action which normally biases the retainer clip to hold the male component and the female component of the two part electrical connectorsuitably engaged with a continuously applied force such that the engagement resists shock and vibrational forces which might otherwise dislodge the engagement therebetween.

21. The electrical connector according to claim 20 wherein the feet are selectively positionable with respect to one another to facilitate engagement of the feet with the apertures extending through the female component of the connector.

22. The electrical connector according to claim 20 wherein the camming members flex the retainer clip into an open configuration upon engagement with the male component of the two part electrical connector to enable the retainer clip to be extended over the two part electrical connector and thereafter release the retainer clip to resiliently clamp the male and female components of the two part electrical connector in engagement with one another.

23. The electrical connector according to claim 20 wherein the feet comprise toes which are extendable upwardly adjacent to the second side.

24. The electrical connector according to claim 20 further comprising a printed circuit board, and wherein the female component is attached to the printed circuit board and the male component comprises a ribbon cable.

25. The electrical connector according to claim 20 wherein the connecting means comprises a handle which facilitates flexure of the engaging arm away from the feet thereby facilitating removal of the retainer clip.

26. The electrical connector according to claim 25 wherein the handle is adapted to open the retainer clip responsive to the application of a force thereto.

* * * * *

UNITED STATES PATENT AND TRADEMARK OFFICE

CERTIFICATE OF CORRECTION

PATENT NO. : 6,851,964 B2
DATED : February 8, 2005
INVENTOR(S) : William H. Miller It is certified that error appears in the above-identified patent and that said Letters Patent is hereby corrected as shown below:

Title page,
Item [57], ABSTRACT,
Line 10, replace “cramming” with -- camming --.

Column 1,
Line 22, replace “application a ribbon” with -- application, a ribbon --.
Line 35, replace “and engagement” with -- in engagement --.
Line 32, replace “applications actuation” with -- applications, actuation --.
Line 36, replace “vibration is encountered” with -- vibration is encountered, --.

Column 2,
Line 63, replace “connector 10 the” with -- connector 10, the --.

Column 6,
Line 66, replace “connectorssuitably” with -- connectors suitably --.

Signed and Sealed this

Thirty-first Day of May, 2005

JON W. DUDAS
*Director of the United States Patent and Trademark Office*